US012372023B2

(12) United States Patent
Klisowski et al.

(10) Patent No.: US 12,372,023 B2
(45) Date of Patent: Jul. 29, 2025

(54) BALL VALVE THERMOSTAT ASSEMBLY

(71) Applicant: FCA US LLC, Auburn Hills, MI (US)

(72) Inventors: Arturo L Klisowski, Novi, MI (US); Eduardo Fernandes Goncalves, Troy, MI (US); John M Price, Livonia, MI (US); Joseph T Berry, Davison, MI (US); Ronald A Dallison, Farmington Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/952,884

(22) Filed: Sep. 26, 2022

(65) Prior Publication Data

US 2024/0102414 A1 Mar. 28, 2024

(51) Int. Cl.

| | |
|---|---|
| ***F16K 5/04*** | (2006.01) |
| ***F01P 7/16*** | (2006.01) |
| *F01P 7/14* | (2006.01) |

(52) U.S. Cl.

CPC ..... *F01P 7/16* (2013.01); *F01P 2007/146* (2013.01)

(58) Field of Classification Search

CPC ..... F16K 5/04; F16K 5/0407; F16K 5/0457; F16K 5/205; F16K 5/207; F16K 5/208; F16K 5/0689; F16K 5/0657; F16K 5/10; F16K 5/0605

See application file for complete search history.

(56) References Cited

U.S. PATENT DOCUMENTS

| | | | | |
|---|---|---|---|---|
| 3,422,849 | A * | 1/1969 | Manoogian | F16K 11/022 251/315.16 |
| 3,674,052 | A * | 7/1972 | Hartman | F16K 5/08 137/625.21 |
| 3,841,601 | A * | 10/1974 | Grove | F16K 27/107 137/246.22 |
| 4,776,364 | A * | 10/1988 | Staude | F16K 27/067 251/304 |
| 5,435,521 | A * | 7/1995 | Jarecki | F16K 5/0605 251/315.16 |
| 7,455,372 | B2 * | 11/2008 | Wang | B60T 17/043 303/56 |
| 8,522,814 | B2 | 9/2013 | Kempf et al. | |
| 9,366,344 | B2 | 6/2016 | Rogge et al. | |

(Continued)

FOREIGN PATENT DOCUMENTS

| | | | |
|---|---|---|---|
| CN | 110242764 A | * | 9/2019 |
| CN | 212563432 U | | 2/2021 |

(Continued)

*Primary Examiner* — Lindsay M Low
*Assistant Examiner* — Teuta B Holbrook
(74) *Attorney, Agent, or Firm* — Jeremy J. Klobucar

(57) ABSTRACT

A ball valve for a ball valve assembly having a housing with a housing sealing surface configured to selectively seal against the ball valve. The ball valve includes an outer sealing surface configured to selectively seal against the housing sealing surface, and a recessed surface set inward of the outer sealing surface and defining a reservoir within the outer sealing surface. As the ball valve rotates between open and closed positions, the reservoir establishes a gap between the recessed surface and the housing sealing surface that enables debris to pass therethrough and facilitate preventing debris accumulation between the ball valve and the housing sealing surface.

12 Claims, 7 Drawing Sheets

(56) References Cited

U.S. PATENT DOCUMENTS

| | | | | |
|---|---|---|---|---|
| 9,453,579 | B2 | 9/2016 | Bisio et al. | |
| 9,964,329 | B2 * | 5/2018 | Whitmore | F16K 11/0873 |
| 10,222,813 | B2 | 3/2019 | Carns | |
| 10,287,965 | B2 | 5/2019 | Spenny | |
| 10,393,275 | B2 | 8/2019 | Patil et al. | |
| 10,400,900 | B2 | 9/2019 | Kindersley et al. | |
| 2008/0105845 | A1 * | 5/2008 | Yeary | F16K 5/0605 251/315.01 |
| 2015/0286224 | A1 | 10/2015 | Bartonek | |
| 2015/0316157 | A1 | 11/2015 | Zikeli et al. | |
| 2017/0101921 | A1 * | 4/2017 | Crusius | F16K 11/087 |
| 2017/0363223 | A1 | 12/2017 | Heldberg | |
| 2022/0003076 | A1 * | 1/2022 | Reid | E21B 34/06 |

FOREIGN PATENT DOCUMENTS

| | | | | |
|---|---|---|---|---|
| CN | 114635998 | A * | 6/2022 | |
| DE | 10235997 | A1 * | 2/2004 | F02B 27/0257 |
| JP | 59175679 | A * | 10/1984 | |
| KR | 101039109 | B1 | 6/2011 | |
| PL | 187123 | B1 * | 5/2004 | |
| WO | WO-0051923 | A1 * | 9/2000 | F16K 47/045 |

* cited by examiner

BALL VALVE THERMOSTAT ASSEMBLY

FIELD

The present application relates generally to thermostats for vehicle coolant systems and, more particularly, to a ball valve thermostat with a contaminant buildup reducing valve surface.

BACKGROUND

Ball valve thermostats are useful solutions for modern high efficiency powertrains where low flow restriction is desired. However, with a partially closed valve, debris in the fluid can drop out of the of fluid flow stream and accumulate at the seal surface. Actuation of the valve can then force the debris into close clearance areas between the valve and housing, which can potentially increase friction of the mechanism and lead to possible valve seizure and functional failure. Such issues are particularly prevalent for ball valve thermostats arranged on an inlet side of the engine, which is at a low point on the coolant system where such contaminants are likely to accumulate under the effect of gravity. Thus, while such systems do work well for their intended purpose, it is desirable to provide continuous improvement in the relevant art.

SUMMARY

According to one example aspect of the invention, a ball valve for a ball valve assembly having a housing with a housing sealing surface configured to selectively seal against the ball valve is provided. In one exemplary implementation, the ball valve includes an outer sealing surface configured to selectively seal against the housing sealing surface, and a recessed surface set inward of the outer sealing surface and defining a reservoir within the outer sealing surface. As the ball valve rotates between open and closed positions, the reservoir establishes a gap between the recessed surface and the housing sealing surface that enables debris to pass therethrough and facilitate preventing debris accumulation between the ball valve and the housing sealing surface.

In addition to the foregoing, the described ball valve may include one or more of the following features: wherein in the closed position, a perimeter shape of the recessed surface is entirely contained within an outer perimeter of a fluid port of the ball valve assembly housing; wherein the recessed surface is offset from the outer sealing surface in a radially inward direction and substantially parallel to the outer sealing surface; wherein the recessed surface is concave; and wherein the reservoir defines a directional channel extending substantially orthogonal to an axis of rotation of the ball valve.

In addition to the foregoing, the described ball valve may include one or more of the following features: wherein the recessed surface defines a plurality of directional ribs defining a plurality of directional tracks between adjacent directional ribs, the directional tracks configured to direct debris through the reservoir; wherein the plurality of directional ribs and plurality of directional tracks extend substantially orthogonal to an axis of rotation of the ball valve; wherein the recessed surface is concave; and wherein the recessed surface defines a perimeter shape having a generally straight portion, a pair of upper and lower portions that diverge from each other as they extend from opposite ends of the straight portion, and a rounded portion that extends between distal ends of the upper and lower portions.

According to another example aspect of the invention, a ball valve assembly is provided. In one exemplary implementation, the assembly includes a housing defining a ball cavity, a first inlet port, a second inlet port, and an outlet port. A ball valve is disposed in the ball cavity and configured to move between a first position opening the first inlet port and closing the second inlet port, and a second position closing the first inlet port and opening the second inlet port. An actuator assembly is configured to move the ball valve between the first and second positions. The ball valve includes (i) an outer sealing surface configured to selectively seal against a sealing surface of the housing when in the first position, and (ii) a recessed surface set inward of the outer sealing surface and defining a reservoir within the outer sealing surface. As the ball valve rotates between the first and second positions, the reservoir establishes a gap between the recessed surface and the housing sealing surface that enables debris to pass therethrough and facilitate preventing debris accumulation between the ball valve and the housing sealing surface.

In addition to the foregoing, the described assembly may include one or more of the following features: wherein the actuator assembly includes a motor; wherein the first inlet port is configured to receive hot coolant from a vehicle engine, the second inlet port is configured to receive coolant from a vehicle radiator, and the outlet port is configured to direct coolant to the engine; the ball valve assembly is a ball valve thermostat assembly for a vehicle engine cooling system; and wherein in the closed position, a perimeter shape of the recessed surface is entirely contained within an outer perimeter of a fluid port of the ball valve assembly housing.

In addition to the foregoing, the described assembly may include one or more of the following features: wherein the recessed surface is offset from the outer sealing surface in a radially inward direction and substantially parallel to the outer sealing surface; wherein the recessed surface is concave; wherein the recessed surface defines a plurality of directional ribs defining a plurality of directional tracks between adjacent directional ribs, the directional tracks configured to direct debris through the reservoir; and wherein the recessed surface is concave.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The present application is generally directed to a ball valve thermostat assembly for a vehicle engine cooling system. The assembly includes a ball valve with an outer surface having recessed portions to offset the ball valve from a sealing surface in the thermostat assembly. The surface features are configured to allow fluid flow around the ball valve during opening/closing to thereby prevent accumulation of contaminants/debris on the sealing surfaces that can potentially result in damage to the valve or cause the valve to stick. As such, the ball valve thermostat assembly allows for full sealing when in a fully closed position, while providing a debris bypass that allows fluid and debris to pass around the ball valve when not in the full closed position.

Figure 1:
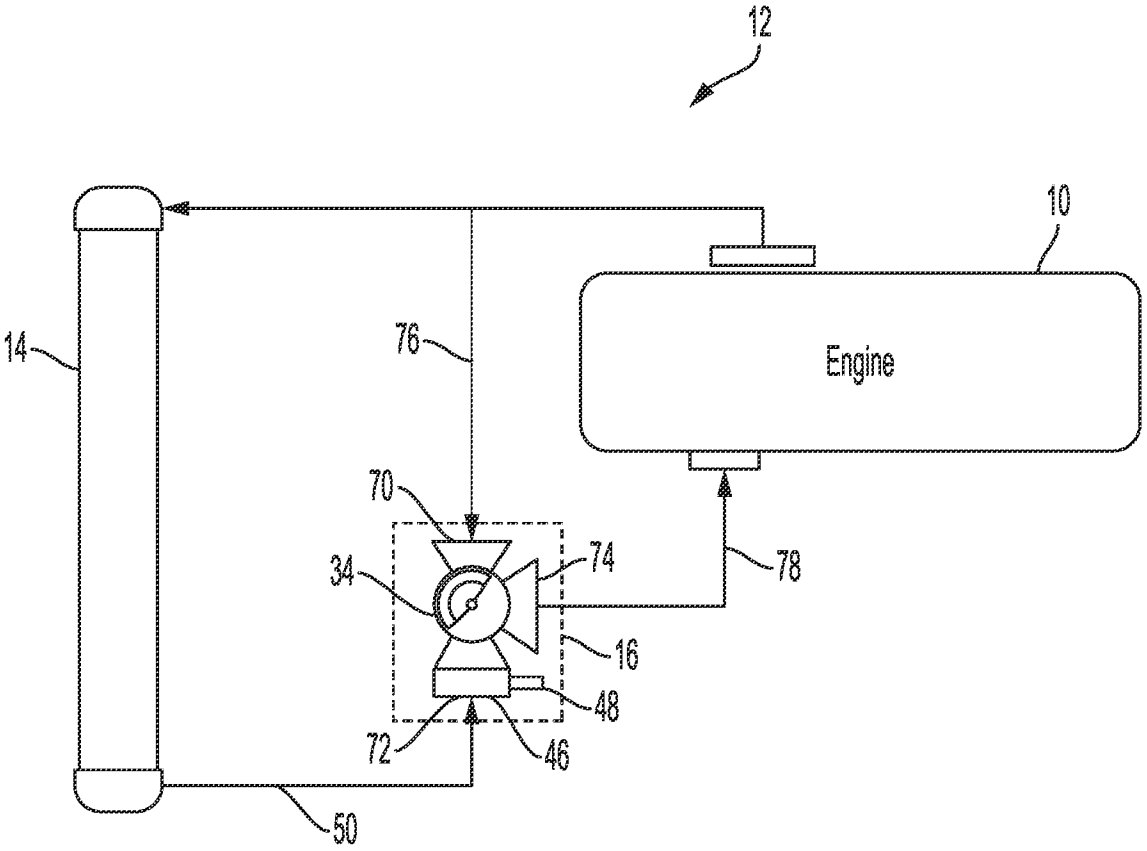
FIG. 1 is a schematic illustration of an engine cooling system in accordance with the principles of the present disclosure.
Figure 2:
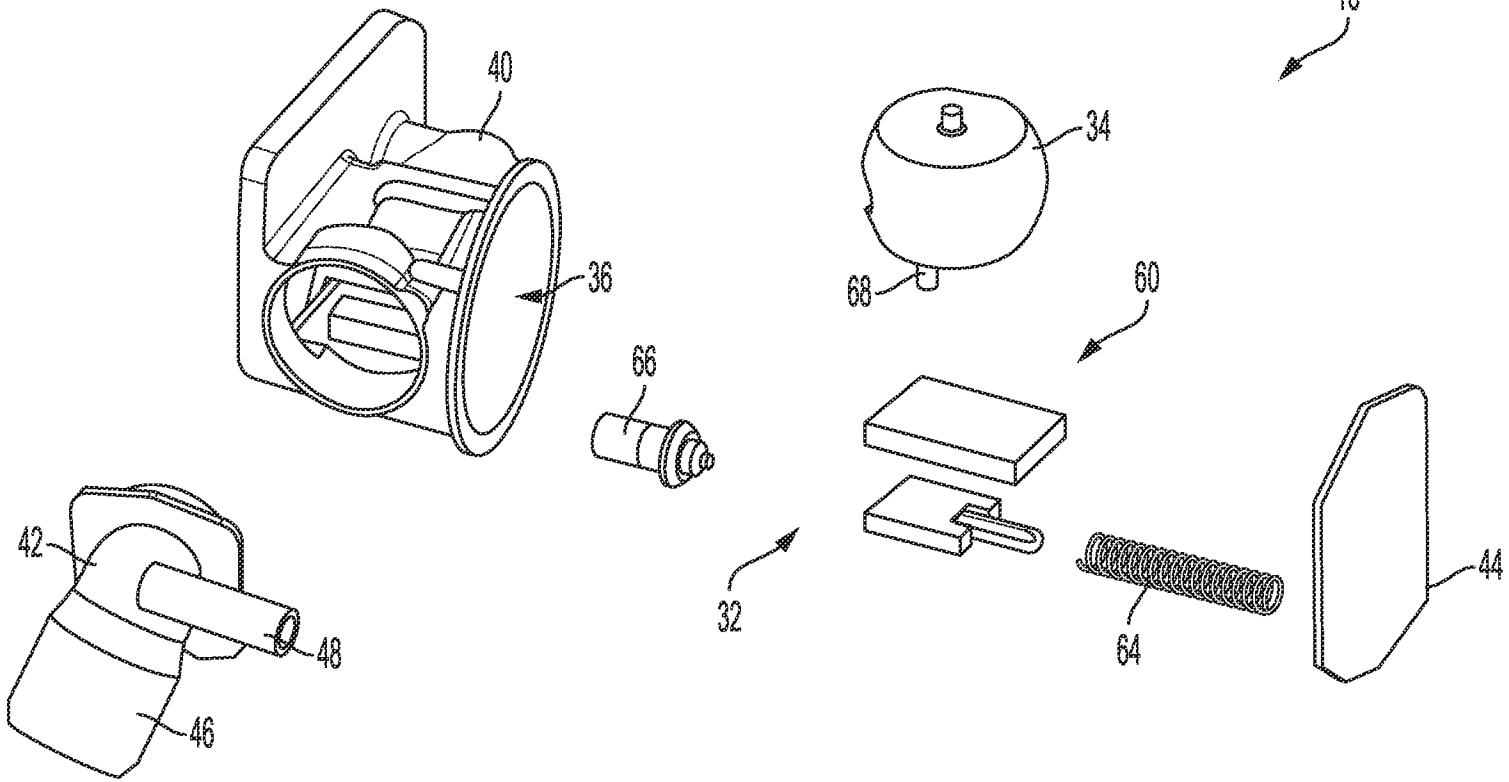
FIG. 2 is an exploded view of an example ball valve thermostat assembly shown in FIG. 1, in accordance with the principles of the present disclosure.

With initial reference to FIG. 1, an example internal combustion engine for a vehicle is schematically illustrated and generally identified at reference numeral 10. A cooling system 12 is provided for thermal management of the engine 10 and associated components such as, for example, a transmission (not shown). The cooling system 12 generally includes a radiator 14 and a ball valve thermostat 16. In the example embodiment, the ball valve thermostat assembly 16 is configured to selectively control coolant flow through the cooling system 12. For example, during an engine cold start, the thermostat assembly 16 is configured to bypass the radiator 14 and direct coolant from the engine 10 via a conduit 76, through the thermostat assembly 16, and directly back to the engine for rapid warming. Once the engine 10 has reached a predetermined temperature, the thermostat assembly 16 is configured to close the bypass and direct coolant from the engine 10 to the radiator 14 to thereby reduce the coolant temperature before returning to the engine 10.

With reference now to FIGS. 2-5, the ball valve thermostat assembly 16 will be described in more detail. In the example embodiment, the ball valve thermostat assembly 16 generally includes a housing 30, an actuator assembly 32, and a ball valve 34. As described herein in more detail, the ball valve 34 includes recessed surface features to provide a bypass between the ball valve 34 and the housing 30 to thereby facilitate preventing debris accumulation between the ball valve 34 and sealing surfaces of housing 30.

In the example embodiment, housing 30 generally includes a main body 40, a port attachment 42, and a cover 44. The main body 40 defines a ball cavity 36 configured to receive the ball valve 34. The port attachment 42 includes a radiator port 46 and a transmission oil heater port 48. The radiator port 46 is configured to receive coolant from the radiator 14 via a conduit 50 (FIG. 1), and the transmission oil heater port 48 is configured to receive coolant from a transmission oil heater (not shown). The cover 44 is configured to attach to main body 40 and at least partially house/support the actuator assembly 32. Although shown in FIG. 2 as separately coupled to the main body 40, port attachment 42 and cover 44 may be integrally formed with the main body 40.

In the example implementation, the actuator assembly 32 is configured move the ball valve 34 between open and closed positions. In the illustrated example, actuator assembly 32 generally includes a carriage 60, a return spring 64, and a wax motor 66. However, it will be appreciated that actuator assembly 32 may have any suitable configuration that enables ball valve thermostat assembly 16 to function as described herein. In this example, the carriage 60 supports the ball valve 34 and is operably coupled thereto. Linear motion from the wax motor 66 translates the carriage 60 to rotate the ball valve between fully open and fully closed positions. The return spring 64 is configured to bias the carriage 60 into a default position.

In the example embodiment, the wax motor 66 includes a wax encapsulation and is configured to function through a phase change of the wax from a solid to a liquid. When the wax melts due to an increase in temperature of coolant flowing around it, the wax volume increases, thereby forcing the wax motor 66 to grow in length. This in turn translates the carriage 60 against the biasing force of return spring 64 to engage and translate a crank 68 of the ball valve 34. Actuation of the crank 68 rotates the ball valve 34 around its axis to open or close the ball valve 34, as described herein.

Figure 4:
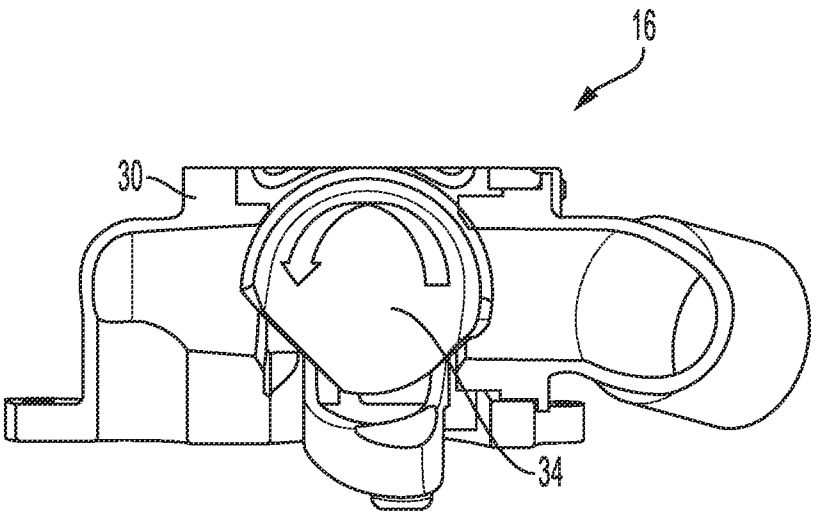
FIG. 4 is sectional view of the ball valve thermostat assembly of FIG. 3 in a second position in accordance with the principles of the present disclosure.
Figure 3:
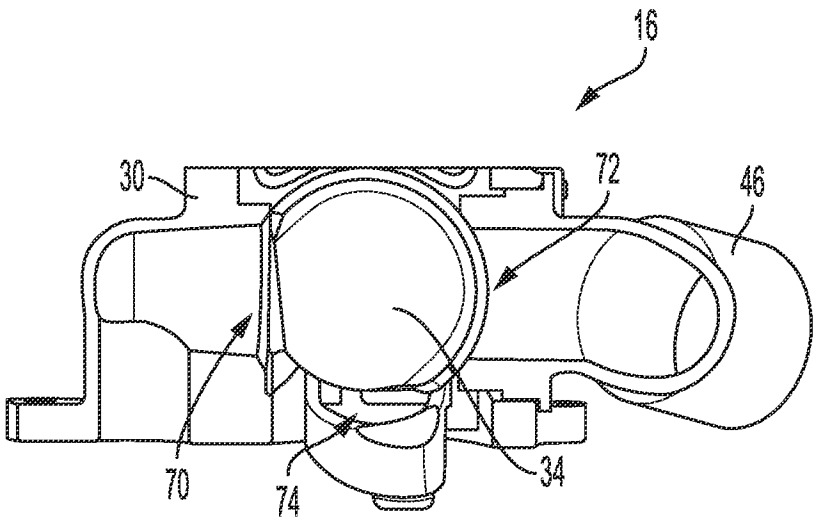
FIG. 3 is sectional view of the ball valve thermostat assembly of FIG. 2 in a first position in accordance with the principles of the present disclosure.
Figure 5:
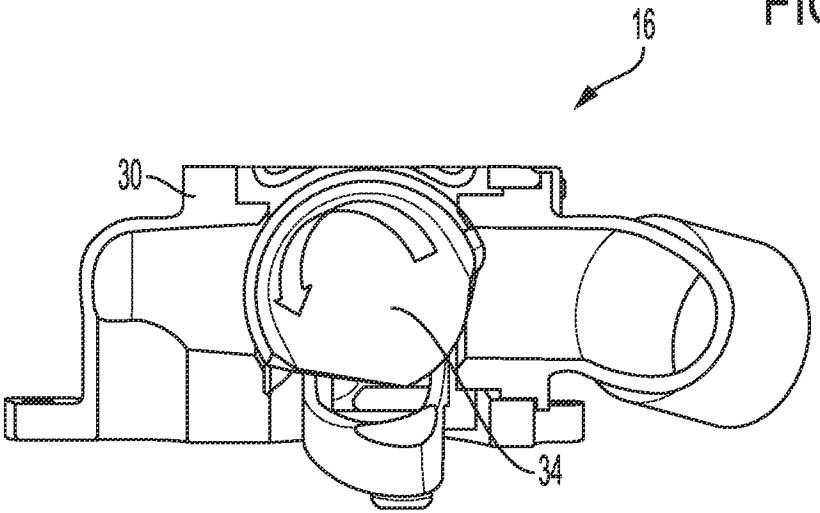
FIG. 5 is sectional view of the ball valve thermostat assembly of FIG. 3 in a third position in accordance with the principles of the present disclosure.

As shown in FIGS. 3-5, the thermostat housing 30 defines a first inlet port 70, a second inlet port 72, and an outlet port 74. The first inlet port 70 is configured to receive coolant from the engine 10 via a conduit 76 (FIG. 1), and the second inlet port 72 is configured to receive coolant from the radiator 14 (via conduit 50 and radiator port 46) and/or the transmission oil heater (via transmission oil heater port 48). Coolant received from the first or second inlet ports 70, 72 is subsequently directed through the outlet port 74 to a conduit 78 and back to the engine 10 for heating/cooling thereof. As shown, the ball valve 34 is disposed within the housing 30 and operable to selectively close the first inlet port 70 or the second inlet port 72. FIG. 3 illustrates the ball valve 34 in a first or radiator closed position where the first inlet port 70 is open and the second inlet port 72 is closed such that heated coolant flow from the engine 10 bypasses the radiator 14 and is immediately returned to the engine 10 (e.g., for rapid engine warming). FIG. 4 illustrates ball valve 34 in a partially open/closed position as it is rotated to a second or radiator open position (FIGS. 1 and 5) where the first inlet port 70 is closed and the second inlet port 72 is open. In this second position, the radiator bypass is closed, and cooled coolant flow is received from the radiator 14 and returned to the engine 10 for cooling thereof.

Figure 7:
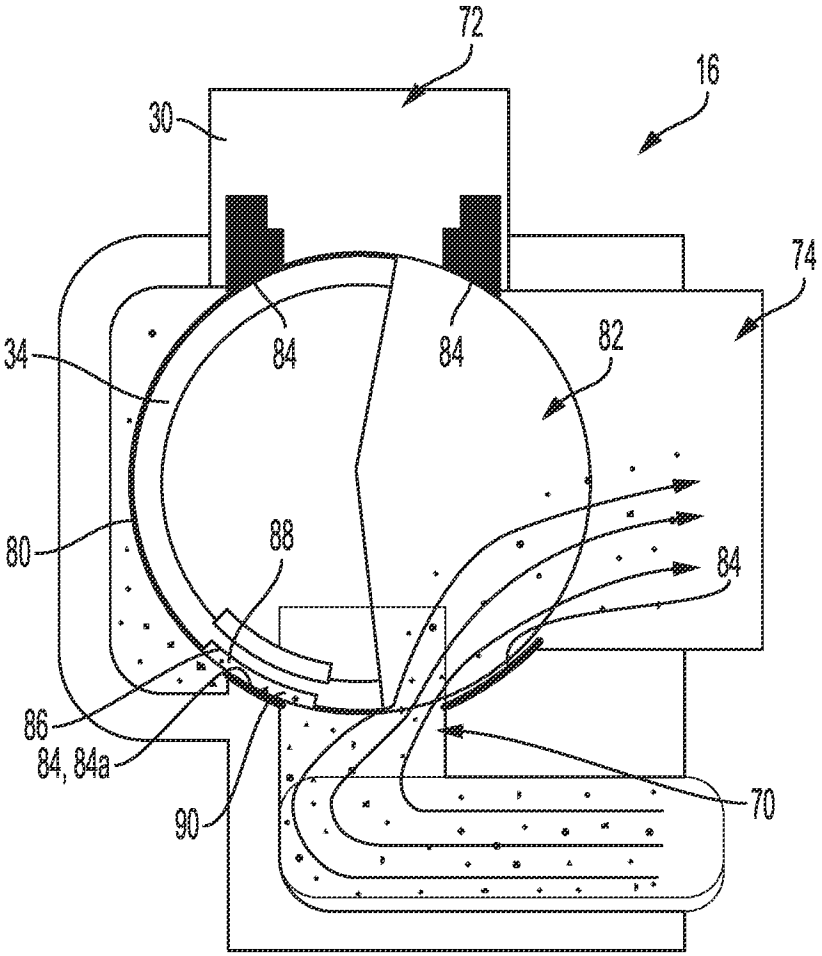
FIG. 7 is a schematic illustration of the ball valve thermostat assembly in the second position, in accordance with the principles of the present disclosure.
Figure 6:
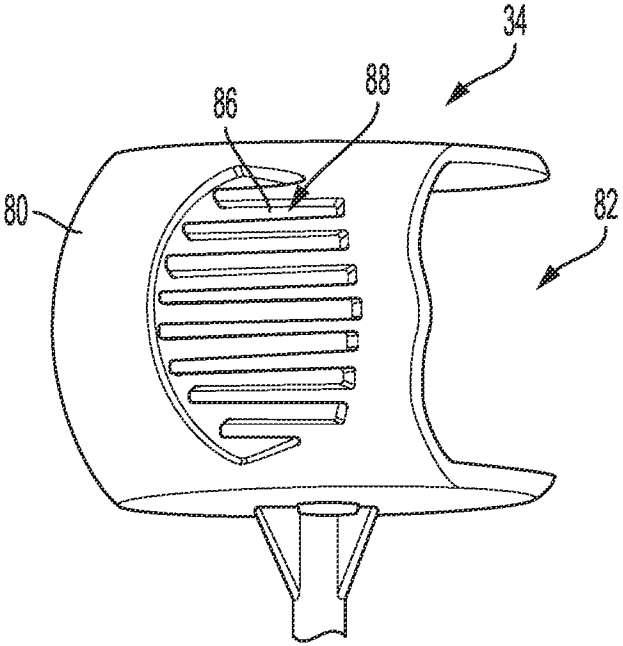
FIG. 6 is an enlarged perspective view of an example ball valve shown in FIG. 2, in accordance with the principles of the present disclosure.

With reference now to FIGS. 6 and 7, the ball valve 34 will be described in more detail. In the example embodiment, ball valve 34 has a generally truncated hemispherical shape with an outer sealing surface 80. As illustrated, the outer sealing surface 80 in cross-section is a partial circumference (e.g., 190°-210° in FIG. 7) such that ball valve 34 defines an open area or portion 82. The outer sealing surface 80 is configured to selectively seal against housing sealing surfaces 84 as ball valve 34 is moved between the first and second positions. However, due to the potential valve jamming issues described above that can be caused by debris in the coolant, outer sealing surface 80 further includes a recessed surface 86.

Figure 8B:
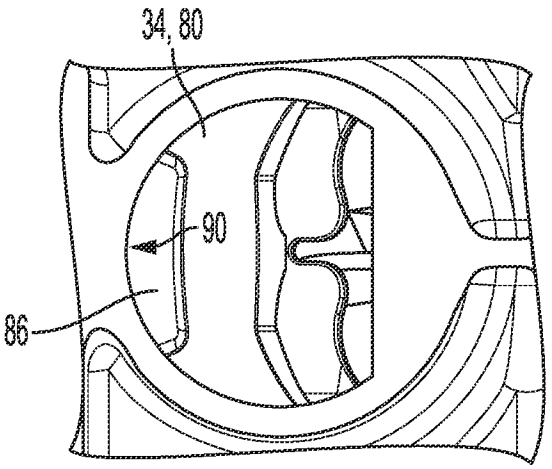
FIG. 8B is a side view of the ball valve of FIG. 8A in a partially open position in accordance with the principles of the present disclosure.
Figure 8C:
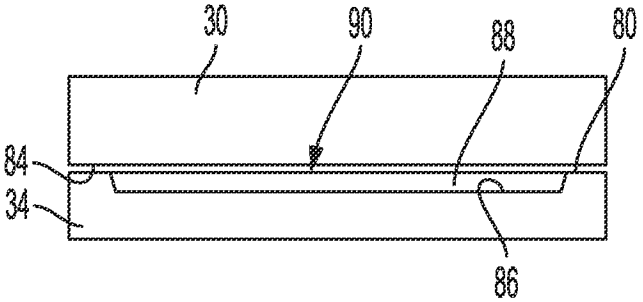
FIG. 8C is a cross-sectional view of an example recessed surface of the ball valve of FIG. 8A, in accordance with the principles of the present disclosure.
Figure 8A:
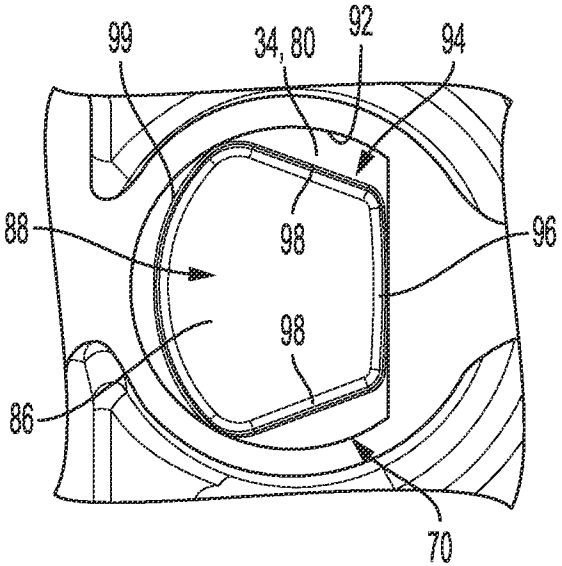
FIG. 8A is a side view of one example ball valve in a closed position, in accordance with the principles of the present disclosure.

In the example embodiments, recessed surface 86 is set radially inward of the outer sealing surface 80 so as to be spaced apart from a housing sealing surface 84*a* during rotation of the ball valve 34. As such, recessed surface 86 defines a reservoir 88 configured to establish a gap 90 (FIG. 7) that allows debris to pass therethrough, thus facilitating preventing or mitigating debris accumulation and/or jamming of debris between the ball valve 34 and the housing sealing surface 84*a*. Moreover, in the second position (radiator open), the recessed surface 86 is contained within a port outer perimeter 92 (e.g., see FIG. 8A) such that outer sealing surface 80 is fully sealed against housing sealing surfaces 84.

With reference now to FIGS. 8-11, various configurations of the recessed surface 86 are illustrated and described. FIGS. 8A-8C illustrate a first configuration where recessed surface 86 is generally offset from the outer sealing surface 80 in a radially inward direction and parallel or substantially parallel thereto. As shown in FIG. 8A, in the example embodiment, the perimeter shape 94 of the recessed surface 86 includes a generally straight portion 96, a pair of upper and lower portions 98 that diverge from each other as they extend from opposite ends of the straight portion 96, and a rounded portion 99 that extends between distal ends of the upper and lower portions 98. As previously mentioned, the perimeter shape 94 of recessed surface 86 is entirely contained within the port outer perimeter 92 when in the valve closed position. As shown in FIG. 8B, with ball valve 34 in the partially open/closed position, recessed surface 86 provides gap 90 for debris passage therethrough.

Figure 9B:
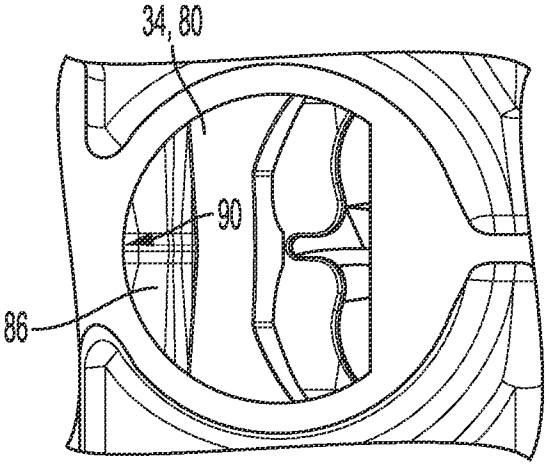
FIG. 9B is a side view of the ball valve of FIG. 9A in a partially open position in accordance with the principles of the present disclosure.
Figure 9C:
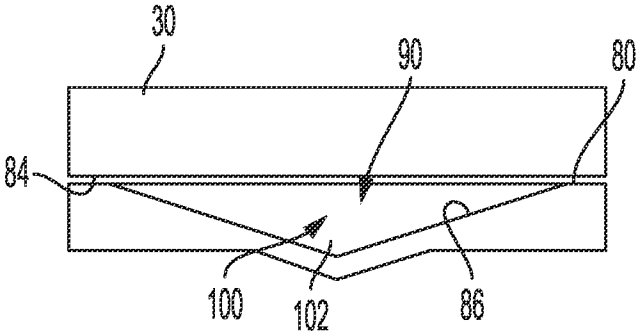
FIG. 9C is a cross-sectional view of an example recessed surface of the ball valve of FIG. 9A, in accordance with the principles of the present disclosure.
Figure 9A:
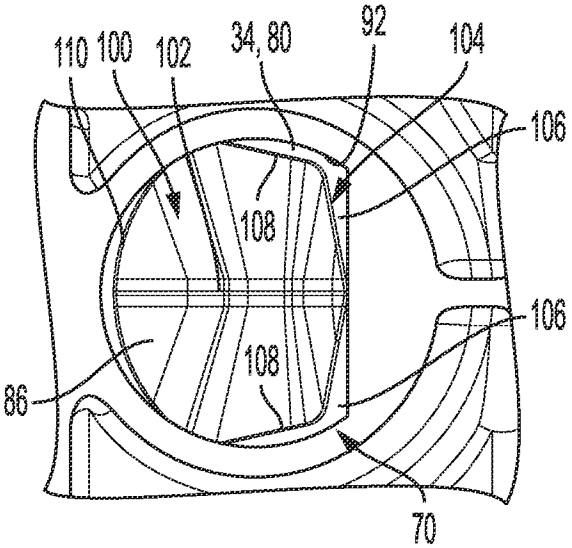
FIG. 9A is a side view of another example ball valve in a closed position, in accordance with the principles of the present disclosure.

FIGS. 9A-9C illustrate a second configuration where recessed surface 86 is generally offset from the outer sealing surface 80 in a radially inward direction, but also includes a concave cross-sectional shape (FIG. 9C) defining a reservoir 100. Further, the deepest portion of the reservoir 100 defines a directional channel 102 extending orthogonal to or substantially orthogonal to the ball valve axis of rotation. As such, the directional channel 102 is configured to direct debris entering the reservoir 100 through gap 90 during ball valve rotation.

As shown in FIG. 9A, in the example embodiment, a perimeter shape 104 of the recessed surface 86 includes a pair of diverging straight portions 106, a pair of upper and lower portions 108 that diverge from distal ends of the diverging straight portions 106, and a rounded portion 110 that extends between distal ends of the upper and lower portions 108. As previously mentioned, the perimeter shape 104 of recessed surface 86 is entirely contained within the port outer perimeter 92 when in the valve closed position. As shown in FIG. 9B, with ball valve 34 in the partially open/closed position, recessed surface 86 provides gap 90 for debris passage therethrough.

Figure 10B:
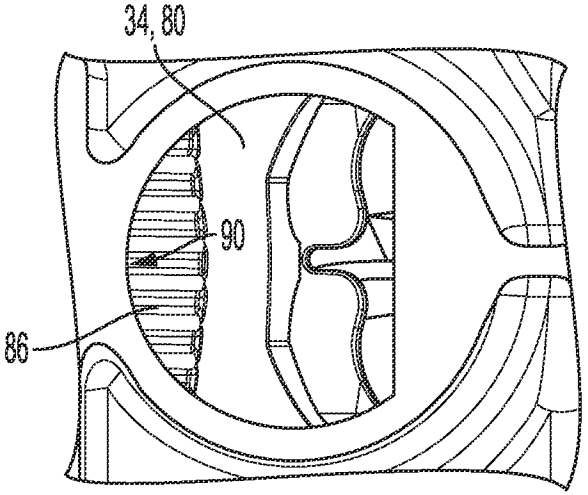
FIG. 10B is a side view of the ball valve of FIG. 10A in a partially open position in accordance with the principles of the present disclosure.
Figure 10A:
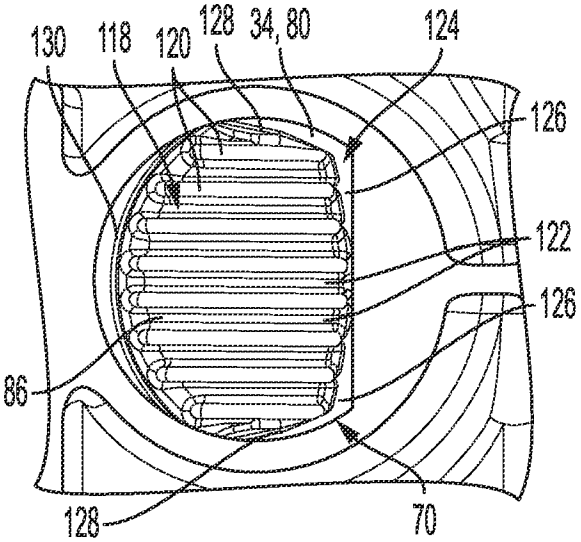
FIG. 10A is a side view of yet another example ball valve in a closed position, in accordance with the principles of the present disclosure.
Figure 10C:
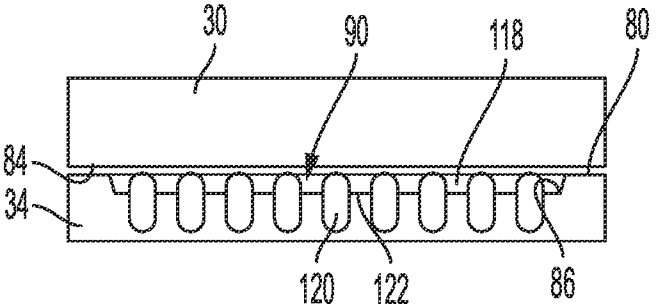
FIG. 10C is a cross-sectional view of an example recessed surface of the ball valve of FIG. 10A, in accordance with the principles of the present disclosure.

FIGS. 10A-10C illustrate a third configuration where recessed surface 86 is generally offset from the outer sealing surface 80 in a radially inward direction to define a reservoir 118, but also includes directional ribs 120 extending orthogonal to or substantially orthogonal to the ball valve axis of rotation. Directional tracks 122 are defined between adjacent directional ribs 120 and are configured to direct debris entering the gap 90 during ball valve rotation.

As shown in FIG. 10A, in the example embodiment, a perimeter shape 124 of the recessed surface 86 includes a pair of diverging straight portions 126, a pair of upper and lower portions 128 that diverge from distal ends of the diverging straight portions 126, and a rounded portion 130 that extends between distal ends of the upper and lower portions 128. As previously mentioned, the perimeter shape 124 of recessed surface 86 is entirely contained within the port outer perimeter 92 when in the valve closed position. As shown in FIG. 10B, with ball valve 34 in the partially open/closed position, recessed surface 86 provides gap 90 for debris passage therethrough along the directional tracks 122.

Figure 11:
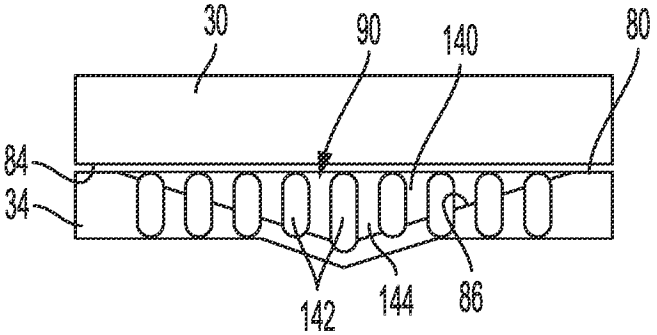
FIG. 11 is a cross-sectional view of yet another example recessed surface of a ball valve, in accordance with the principles of the present disclosure.

FIG. 11 illustrates a fourth configuration where recessed surface 86 is a combination of the second and third configurations such that recessed surface 86 includes a concave cross-section defining a reservoir 140 with directional ribs 142 and directional tracks 144. Recessed surface 86 may have a perimeter shape similar to that of the second and third configurations. However, it will be appreciated that the recessed surface configurations shown in FIGS. 8-11 may have any suitable shape that enables recessed surface 86 to function as described herein. Moreover, although only one recessed surface 86 is shown formed in the ball valve 34 at the bypass port 70, it will be appreciated that a recessed surface may additionally or alternatively be formed in the portion of the ball valve 34 associated with the radiator inlet port 72 to function in a similar manner.

Described herein are systems and methods for preventing accumulation of debris between ball valve and housing sealing surfaces. The ball valve includes a portion with a recessed surface inwardly offset from an outer sealing surface to establish a gap between the ball valve and housing sealing surfaces during rotational movement of the ball valve. The gap enables debris in the coolant to pass unimpeded around the housing sealing surface to advantageously prevent debris accumulation and jamming of the ball valve.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. A ball valve for a ball valve assembly having a housing with a housing sealing surface configured to selectively seal against the ball valve, the ball valve comprising:

an outer sealing surface configured to selectively seal against the housing sealing surface; and a recessed surface formed in and set inward of the outer sealing surface and defining a reservoir within the outer sealing surface, wherein as the ball valve rotates between open and closed positions, the reservoir establishes a gap between the recessed surface and the housing sealing surface that enables debris to pass therethrough and facilitate preventing debris accumulation between the ball valve and the housing sealing surface, and wherein in the closed position, a perimeter shape of the recessed surface is entirely contained within an outer perimeter of an inlet port of the ball valve assembly housing, wherein the recessed surface defines a plurality of directional ribs defining a plurality of directional tracks between adjacent directional ribs, the directional tracks configured to direct debris through the reservoir, and wherein the plurality of directional ribs and plurality of directional tracks extend (i) substantially orthogonal to an axis of rotation of the ball valve, and (ii) in a direction of rotation of the ball valve.

2. The ball valve of claim 1, wherein the recessed surface is offset from the outer sealing surface in a radially inward direction and substantially parallel to the outer sealing surface.

3. The ball valve of claim 1, wherein the recessed surface defines a perimeter shape having a generally straight portion, a pair of upper and lower portions that diverge from each other as they extend from opposite ends of the straight portion, and a rounded portion that extends between distal ends of the upper and lower portions.

4. The ball valve of claim 1, wherein the plurality of directional ribs comprises nine directional ribs.

5. A ball valve assembly comprising:

a housing defining a ball cavity, a first inlet port, a second inlet port, and an outlet port;

a ball valve disposed in the ball cavity and configured to move between a first position opening the first inlet port and closing the second inlet port, and a second position closing the first inlet port and opening the second inlet port; and an actuator assembly configured to move the ball valve between the first and second positions, wherein the ball valve includes (i) an outer sealing surface configured to selectively seal against a sealing surface of the housing when in the first position, and (ii) a recessed surface set inward of the outer sealing surface and defining a reservoir within the outer sealing surface, wherein as the ball valve rotates between the first and second positions, the reservoir establishes a gap between the recessed surface and the housing sealing surface that enables debris to pass therethrough and facilitate preventing debris accumulation between the ball valve and the housing sealing surface, wherein the recessed surface defines a plurality of directional ribs defining a plurality of directional tracks between adjacent directional ribs, the directional tracks configured to direct debris through the reservoir.

6. The ball valve assembly of claim 5, wherein the actuator assembly includes a motor.

7. The ball valve assembly of claim 5, wherein the first inlet port is configured to receive hot coolant from a vehicle engine, the second inlet port is configured to receive coolant from a vehicle radiator, and the outlet port is configured to direct coolant to the engine.

8. The ball valve assembly of claim 5, wherein the ball valve assembly is a ball valve thermostat assembly for a vehicle engine cooling system.

9. The ball valve assembly of claim 5, wherein in the closed position, a perimeter shape of the recessed surface is entirely contained within an outer perimeter of a fluid port of the ball valve assembly housing.

10. The ball valve assembly of claim 5, wherein the recessed surface is offset from the outer sealing surface in a radially inward direction and substantially parallel to the outer sealing surface.

11. The ball valve assembly of claim 5, wherein the ball valve is a truncated spherical shape, wherein the outer sealing surface forms a partial circumference of the truncated spherical shape such that the ball valve defines an open portion, wherein in the first position, the open portion enables fluid flow from the first inlet port to the outlet port, and wherein in the second position, the open portion enables fluid flow from the second inlet port to the outlet port.

12. The ball valve assembly of claim of claim 5, wherein the plurality of directional ribs and plurality of directional tracks extend (i) substantially orthogonal to an axis of rotation of the ball valve, and (ii) in a direction of rotation of the ball valve.

* * * * *